United States Patent [19]

Degeeter et al.

[11] Patent Number: 4,854,813

[45] Date of Patent: Aug. 8, 1989

[54] COUPLING APPARATUS

[75] Inventors: Robert L. Degeeter, Oswego; Harvey A. Knell, Yorkville, both of Ill.

[73] Assignee: Caterpillar Inc., Peoria, Ill.

[21] Appl. No.: 193,123

[22] Filed: May 6, 1988

Related U.S. Application Data

[63] Continuation of Ser. No. 894,097, Aug. 8, 1986, abandoned, which is a continuation of Ser. No. 665,485, Oct. 29, 1984, abandoned.

[51] Int. Cl.[4] ..... E02F 3/81

[52] U.S. Cl. ..... 414/723; 172/751; 172/753; 403/322; 403/323

[58] Field of Search ..... 414/722, 723, 727; 172/749, 751, 753; 403/322, 323

[56] References Cited

U.S. PATENT DOCUMENTS

| | | | |
|---|---|---|---|
| 2,489,274 | 11/1949 | Forrest | 56/26 |
| 3,220,487 | 11/1965 | Pilch | 172/274 |
| 3,243,066 | 3/1966 | Gardner et al. . | |
| 3,285,625 | 11/1966 | Krueger | 280/479 |
| 3,412,489 | 11/1968 | Klapprodt et al. | 37/42 |
| 3,512,665 | 5/1970 | Westendorf | 414/723 |
| 3,556,323 | 1/1971 | Helmmermann . | |
| 3,672,521 | 6/1972 | Bauer et al. | 214/145 |
| 3,753,508 | 8/1973 | Carpenter | 214/130 R |
| 3,851,894 | 12/1974 | St. Pierre | 280/460 R |
| 3,874,533 | 4/1975 | Montgomery | 214/145 |
| 3,934,738 | 1/1976 | Arnold | 214/145 A |
| 3,935,953 | 2/1976 | Stedman | 414/723 X |
| 3,964,622 | 6/1976 | Blair et al. | 214/145 A |
| 3,984,016 | 10/1976 | Kuhn | 214/131 A |
| 4,013,182 | 3/1977 | Pratt et al. . | |
| 4,043,470 | 8/1977 | Pilch | 214/145 A |
| 4,071,154 | 1/1978 | Retziaff | 214/145 A |
| 4,116,346 | 9/1978 | Uchida . | |
| 4,116,347 | 9/1978 | Uchida . | |
| 4,117,944 | 10/1978 | Beckstrom | 214/131 A |
| 4,127,203 | 11/1978 | Arnold | 214/145 A |
| 4,187,050 | 2/1980 | Barbee | 414/723 |
| 4,208,163 | 6/1980 | Holmgvist | 414/723 |
| 4,213,731 | 7/1980 | Verachtert | 414/723 |
| 4,214,840 | 7/1980 | Beales | 403/31 |
| 4,247,242 | 1/1981 | Goertzen | 414/686 |
| 4,381,167 | 4/1983 | Baty | 414/723 X |
| 4,452,560 | 6/1984 | Coyle et al. | 414/723 |
| 4,459,768 | 7/1984 | Albrecht | 414/722 X |
| 4,509,768 | 4/1985 | Haung | 280/479 R |
| 4,545,720 | 10/1985 | Cochran et al. | 414/723 |
| 4,606,692 | 8/1986 | Langenfeld et al. | 414/686 |
| 4,625,988 | 12/1986 | Witchey et al. | 280/461 A |
| 4,674,945 | 6/1987 | Hulden | 414/723 |

*Primary Examiner*—Robert J. Spar
*Assistant Examiner*—Donald W. Underwood
*Attorney, Agent, or Firm*—William C. Perry

[57] ABSTRACT

In the operation of construction vehicles, it is often desirable to quickly change from one work implement to another for various types of work. In order to accomplish this, adapting brackets or extensive support structure is added to the support arm and operating linkage of the vehicle to mount a specifically design work implement. Such designs have been known to alter the function of the operating linkages to a point where the performance of the work implement is sacrificed both in operational force capabilities and capacity. The coupling apparatus of the subject allows a plurality of work implements to be quickly coupled to and uncoupled from a vehicle. The coupling apparatus does so in a manner that maintains the operating geometry of conventional linkages and thereby maintains the appropriate operational forces needed for manipulation of the work implement with very little reduction in capacity from that of a convention work implement.

17 Claims, 3 Drawing Sheets

COUPLING APPARATUS

This is a continuation of Ser. No. 894,097, filed Aug. 8, 1986, now abandoned, which is a continuation of Ser. No. 665,485, filed Oct. 29, 1984, now abandoned.

TECHNICAL FIELD

This invention relates to a coupling apparatus and more particularly to a coupling apparatus that is utilized to quickly couple and uncouple a variety of work implements to the support arm of a vehicle.

BACKGROUND ART

In the operation of an earthmoving vehicle such as an excavator, it is a common occurrence to encounter different types of materials and digging conditions. As a result, specialized buckets have been designed to be utilized in a specific type of soil or for a specific type of digging operation. Therefore it is not uncommon for an operator of an excavator to switch from one bucket to another to perform a variety of operations.

The excavator bucket linkage commonly includes a support arm or stick, and a bucket rotation linkage that is mounted to the stick. The bucket is mounted at one point to the stick and at another point to the rotation linkage. A pair of pivot pin assemblies are positioned within aligned bores formed between the bucket and excavator linkage at each mounting point. The pin assemblies are mounted within their respective bores with an interference fit or press fit. Removal and replacement of the pin assemblies requires a good deal of time and specialized equipment in most instances. Therefore frequent changes between work implements can be very costly in terms of machine down time. On the other hand, if an implement is not changed because of the time required to do so, the work efficiency of the machine is sacrificed.

To alleviate the aforementioned problem, quick-disconnect mountings of various types have been developed. While many of the current designs function to quickly connect and disconnect the various types of implements to an excavator linkage, their construction has created a compromise in the work efficiency of the implement. In some instances, as in U.S. Pat. No. 4,187,050 issued on Feb. 5, 1980 to Gail G. Barbee and assigned to the assignee of the subject application, an adapting bracket is connected to the excavator linkage where a conventional implement such as a bucket would normally be attached The bracket is provided with a connecting arrangement that engages a number of work implements that have been specifically designed for attachment to the bracket. This results in an alteration in the geometry of the excavator linkage. Since the bucket is no longer connected directly to the stick, its point of rotation, or tipping radius, about its connection to the mounting bracket is offset from that of a conventional bucket. The geometry of the bucket linkage is specifically calculated to apply the optimum force available from an actuating cylinder to the tip of the bucket where the teeth will penetrate the earth. Movement of the point of bucket rotation upsets this condition and the amount of digging force applied to the bucket is greatly reduced.

Other so-called "quick coupling" devices require the use of a bracket assembly that have a pair of upstanding sidewalls that extend between the end of the stick and the bucket rotation linkage. Pivot pins extend through bores in the end of the stick and rotation linkage to mount the bracket assembly thereto. The pivot pins or other bearing structure such as a boss, extends from the outer surface of the sidewalls of the bracket to engage appropriately contoured hinge plates of a bucket. Since the load bearing structure is cantilevered from the sidewalls of the bracket, the forces are not directly transferred from the hinge plates of the work implement to the sidewalls of the bracket. Because the sidewalls of the bracket assembly serve only as support for the load bearing structure, very substantial structural members must be positioned laterally between the sidewalls to strengthen the bracket assembly. The laterally extending structure also provides support for a locking device that is centrally disposed between the sidewalls. The locking device is needed to secure the bucket to the bracket assembly. Since the locking device is offset from the connection between the bracket assembly and the bucket, the forces created during a digging operation are amplified as they are transferred from the pivot pins, through the bracket structure and to the locking device. This requires the locking device, as well as the lateral structural members, to be of very substantial size and weight to accommodate such severe loading. As a result, the entire weight if the bracket assembly and attached bucket is far greater than that of a conventional bucket. The additional weight works as a great disadvantage to the operation of a vehicle. Each pound of additional weight reduces the capacity of the bucket by a pound. Also, for each additional pound at the bucket, an additional two pounds must be added to the counterweight at the opposite end of the vehicle. Two designs of this type are disclosed in U.S. Pat. No. 3,556,323 issued on Jan. 19, 1971 to Damian M. Hermmermann and U.S. Pat. No. 4,214,840 issued on July 29, 1980 to John H. Beales.

The present invention is directed to overcoming one or more of the problems as set forth above.

DISCLOSURE OF THE INVENTION

In one aspect of the present invention a coupling apparatus is provided for mounting a work implement on a movable end of a pair of support arms. The coupling apparatus includes at least one hinge plate mounted on the work implement that has a pair of spaced receptacles opening therefrom. A connector means is provided that is selectively, lockably receivable within the receptacles in bridging relation therebetween for directly pivotally connecting said movable ends of the support arms to the hinge plates at the receptacles A coupling apparatus as set forth above allows the operator of a vehicle to change from one work implement to another in a very short period of time. The connecting links engage the bucket at the same location that a conventional bucket would be pinned to the bucket linkage. Therefore, there is no alteration in the geometry of the bucket linkage from that of a conventional bucket, thus the optimum digging force is available to all of the various work implements. Also, since there is no lateral structure interposed between the connecting links, aside from the pivot pins that connect the respective end portions to the excavator linkage, the weight of the coupling apparatus is very little more than that of a conventionally mounted work implement of the same type. Further, since each connecting link is secured directly to each of the respective hinge plates, the working forces are directly transferred, in-line, from one component to the other for more effective distribution. Therefore it can be seen that a coupling apparatus is provided that provides the capability of interchanging a plurality of work implements in a quick and simple manner without sacrificing the function of each work implement.

BEST MODE FOR CARRYING OUT THE INVENTION

Figure 1:
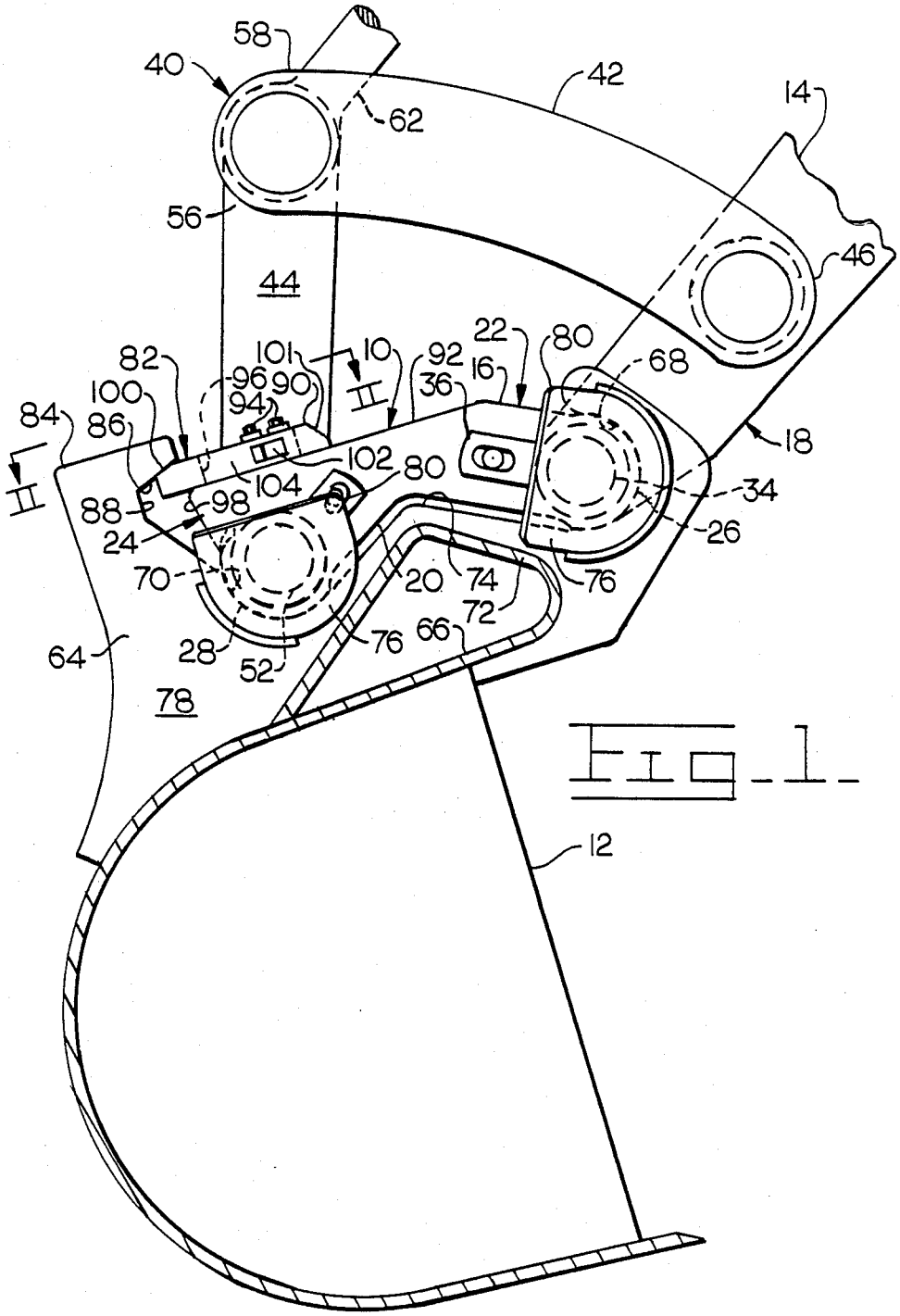
FIG. 1 is a partially sectioned side view of an excavator bucket having a coupling apparatus that embodies the principles of the present invention.

Referring to the drawings and more particularly to FIG. 1, a coupling apparatus 10 is shown that is utilized to attach a work implement 12, such as an excavator bucket, to a vehicle (not shown). The vehicle, in this instance, is an excavator or backhoe that utilizes a compound linkage arrangement to manipulate and load the bucket in a well known manner. The linkage includes a support arm 14 which is commonly referred to as a "stick", to which the bucket is attached in a manner to be described hereinafter.

Figure 3:
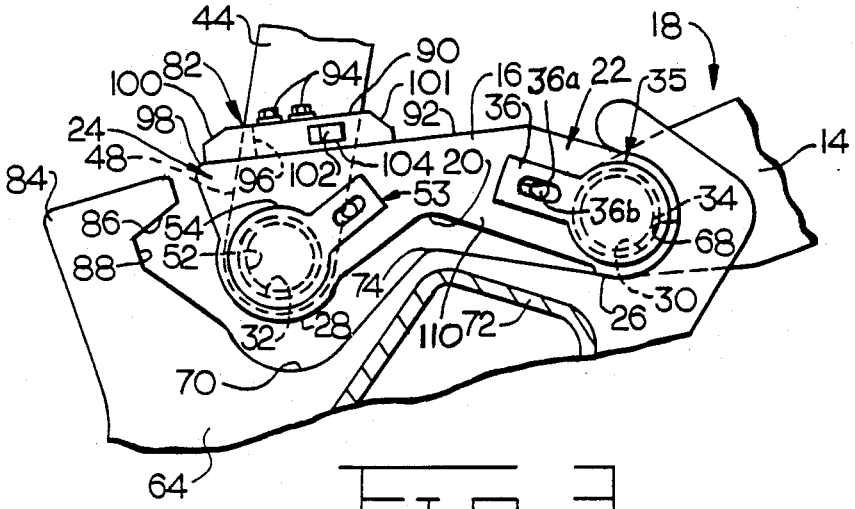
FIG. 3 is a side view of the coupling apparatus partially engaged with a bucket that is shown with portions thereof broken away.

The linkage includes a pair of connecting links 16 that are positioned on opposite sides of a distal end 18 of the stick 14. The connecting links 16 are generally of uniform thickness and are boomerang-shaped to form a concave portion 20 and terminate at first and second end portions 22 and 24. The first end portion 22 is contoured so as to form a generally round profile 26. The second end portion 24 also has a round profile 28 formed thereon. Each end portion 22 and 24 defines a bore 30 and 32, respectively, and the bores 30 in the first end portion 22 are aligned with a bore that extends through the end 18 of the stick 14. As shown in FIGS. 1 and 3, a first pin member 34 is positioned in the aligned bores of the connecting links and the stick to rotatably mount the first end portions 22 of the connecting links 16 to the stick 14. A retaining assembly 35 has a first portion 36 that engages one end of the first pin member 34 to prevent relative rotation thereof with respect to the connecting links 16. The first portion 36 extends outwardly from the pin member 34 to a position adjacent the outer surface 110 of the connecting link 16. A slot 36*a* is defined in the first portion 36 and is of a sufficient size to receive a pin 36*b* that extends outwardly from the surface 110 of the connecting links, as shown in FIG. 3. With the pin 36*b* engaged with the slot 36*a* as such, rotation of the first member 36 and thus the pin 34, with respect to the connecting links, is prevented. A second portion 38 of the retaining assembly 35 engages the opposite end of the first pin member and prevents axial movement of the pin 34 with respect to the connecting links 16.

A rotating means 40 is also associated with the excavator linkage to provide movement of the connecting links 16 about the first pin member 36. The rotation means 40 includes a pair of idler links 42 and a secondary support arm or power link 44 that extend respectively from and are connected to the stick 14 and the connecting links 16. The idler links 42 have a first end portion 46 rotatably mounted to the stick 14 and the power link 44 has a first end portion 48 (FIGS. 2 and 3) rotatably mounted to the second end portions 24 of the connecting links 16. The bores 32 of the second end portions 24 of the connecting links 16 are aligned with a bore 50 that extends through the first end portion 48 of the power link 44. A second pin member 52, identical to the first pin member, is positioned within the aligned bores 32 and 50 to allow relative rotation between the connecting links and the power link. A second retaining assembly 53 has a first and second portion 54 and 55 (FIG. 2) that acts identically to the retaining assembly 55 to secure the second pin member 52 to the connecting links 16. The power link 44 has a second end portion 56 that is rotatably connected to a second end portion 58 of each of the idler links 42. A hydraulic actuator, or cylinder (not shown) has a first end portion 62, in this instance the rod end, that is also connected to the second end portions 56 and 58 of the respective idler and power links 42 and 44. A second end of the cylinder (not shown) is mounted to the stick 14 and upon actuation of the cylinder, causes movement of the rotation means 40 with respect to the stick 14 to pivot the connecting links 16 about the first pin member 34.

The bucket 12 is provided with a pair of mounting plates or hinge plates 64 that are laterally spaced from each other across an upper portion 66 of the bucket 12 and are secured thereto as by welding or other suitable means. First and second receptacles 68 and 70 are formed in each of the hinge plates 64. The first receptacle 68 is substantially semi-circular and is open in a generally rearwardly facing direction, or leftwardly facing as viewed in FIGS. 1 and 3, with respect to the bucket. The second receptacle 70 is spaced rearwardly from the first receptacle 68 and is configured so as to form a portion of a circle that is greater than 90° degrees but less than 180° degrees. The second receptacle 70 opens generally towards the first receptacle 68. A reinforcement beam 72 having a generally triangular configuration extends laterally across the bucket 12 between the hinge plates 64 and defines a convex protrusion 74 that is positioned between the first and second receptacles. Being so configured, the first receptacles 68 act as a socket to receive the rounded profile 26 formed by the first end portions 22 of the connecting links 16. Likewise, the second receptacle 70 receives the portion of the rounded profile 28 formed by the second end portions 24 of the connecting links 16. When the end portions 22 and 24 of the connecting links 16 are engaged with the receptacles 68 and 70, the axial positioning of the connecting links is maintained by a plurality of guide plates 76. The guide plates 76 are secured to an outer surface 78 of the hinge plates 64 and are positioned to cover the outer sides of each receptacle. Each guide plate 76 has a flared portion 80 that extends outwardly from the hinge plates and serves to guide the connecting links into engagement with the receptacles.

Figure 2:
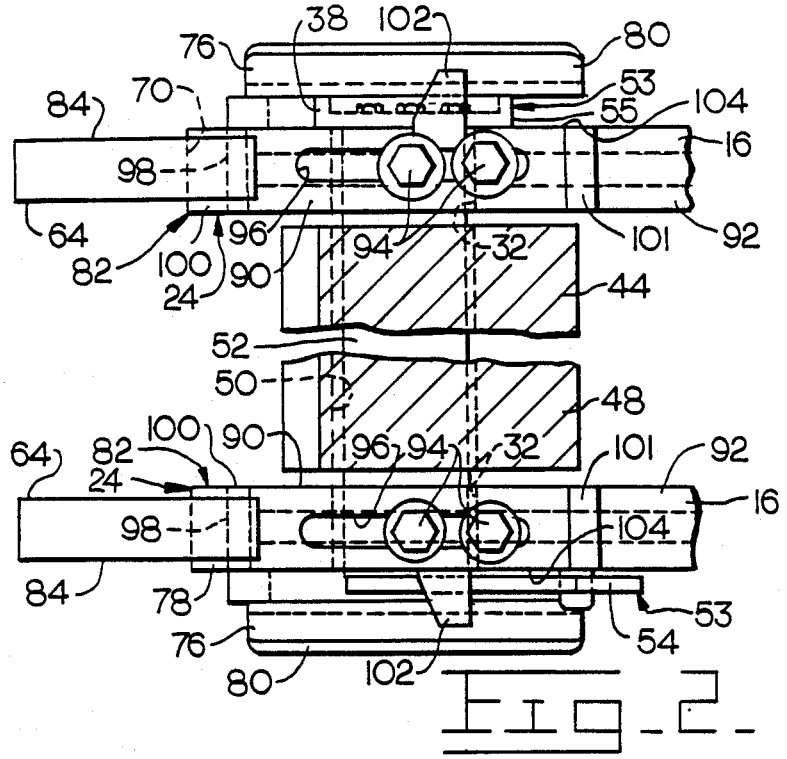
FIG. 2 is a partial top view of the coupling apparatus as viewed along lines II—II in FIG. 1.

The engagement between the end portions 22 and 24 of the connecting links 16 and the respective receptacles 68 and 70 is maintained by a locking means 82 that is associated with each of the connecting links and is shown best in FIGS. 1 and 2. Each locking means includes a hook-shaped flange 84 that extends upwardly from each of the hinge plates 64. The flange 84 has an angled portion 86 formed on a forwardly directed face 88 extending to the right as viewed in FIGS. 1 and 3.

A block-shaped wedge member 90 is positioned on an upper surface 92 of the second end portions 24 of each connecting link 16 in opposing and closely adjacent relation to the angled portion 86 of the flange 84 when the end portions 22 and 24 of the connecting links 16 are nested within the respective receptacles 68 and 70. Each wedge member 90 is secured to the upper surface 92 of the connecting links 16 by a pair of threaded fasteners such as bolts 94. The bolts 94 are positioned in spaced relation to each other in a vertically oriented, oblong slot 96 defined in the wedge member 90. The length of the slot 96 is greater than the spacing between the bolts 94 and thereby allows the movement of the wedge member 90 beyond a rearward edge 98 of the connecting links 16 toward the flange 84. The wedge member 90 also has a pair of angled portions 100 and 101 formed on each end thereof. The wedge member is positioned with the angled portion 100 facing the angled portion 86 of the flange member 84. A lug 102 extends from an outer side 104 of the wedge members 90 and may be utilized, along with angled portion 101, to assist the movement of the wedge members into or out of engagement with the flange member 84.

Figure 4:
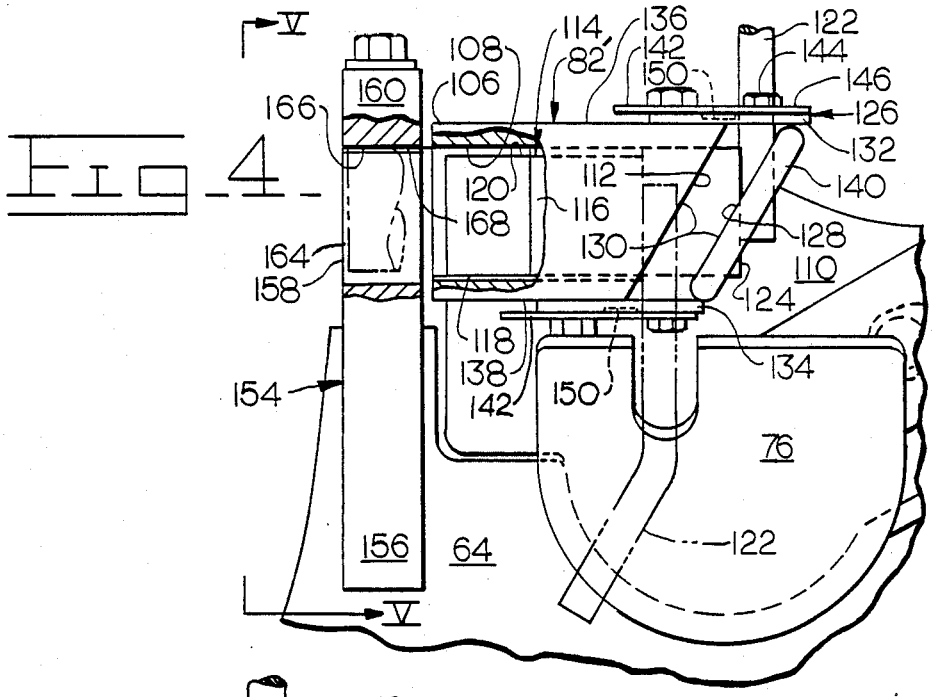
FIG. 4 is an enlarged, partially sectioned side view of an alternate embodiment of a locking apparatus.
Figure 5:
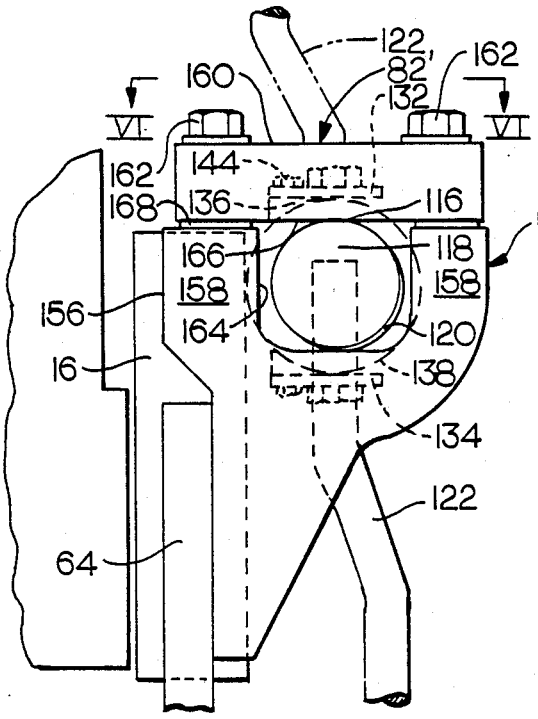
FIG. 5 is an end view of the alternate locking apparatus as viewed along lines V—V of FIG. 4.
Figure 6:
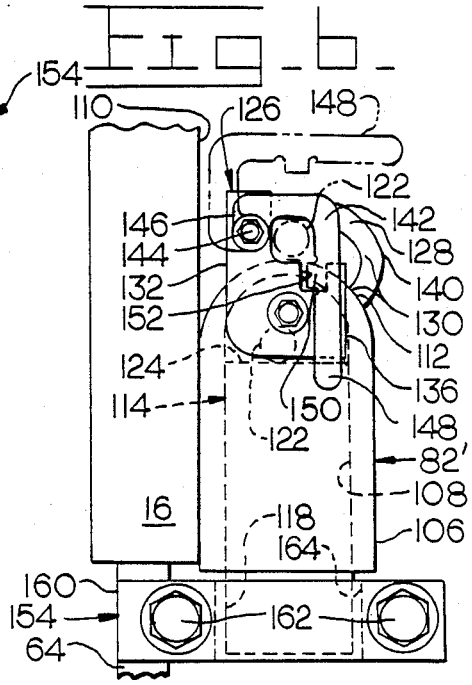
FIG. 6 is a top view of the alternate locking apparatus as viewed along line VI—VI on FIG. 5.

Turning now to FIGS. 4–6, an alternate locking means 82' is disclosed. A pair of locking means 82' is provided, one for each connecting link, and since they are identical, only one will be described hereinafter. Components in the alternate embodiment that are identical to those previously described will be indicated by the same reference numerals. The locking means 82' includes a cylindrical member 106 that defines a bore 108 that extends the entire length of the cylindrical member 106. The cylindrical member is secured to an outer surface 110 of each connecting link 16. An angled surface 112 is defined on a forward or rightward end of the cylindrical member as viewed in FIG. 4. A pin assembly 114 having a round body portion 116 is disposed within the bore 108 of the cylindrical member 106 and has a first end 118 that defines a relieved portion 120 along its circumference. A handle or lever 122 is secured to a second or rearward end 124 of the pin body 116 and extends from the pin body in a direction normal thereto and is positioned adjacent the angled surface 112 of the cylindrical member 106. The lever 122 is retained in its position adjacent the angled surface by a closure element 126. The closure element 126 forms a second angled surface 128 that extends parallel to the angled surface 112 of the cylindrical member 106 and is spaced therefrom to form a slot or track 130 in which the lever 122 may traverse. The closure element 126 includes two horizontally extending plates 132 and 134 that are respectively secured to an upper and lower portion 136 and 138 of the cylindrical member 106 in parallel relation to each other. A semi-circular rod member 140 is secured to each of the plates 132 and 134 and extends therebetween at an angle to form the second angled surface 128 as previously discussed. A generally "L" shaped retainer plate 142 is secured to each of the horizontal plates 132 and 134. A threaded fastener 144, such as a bolt, extends through one end 146 of the retainer plate 142 to secure the end 146 to each of the plates 132 and 134. Only one threaded fastener 144 is used to mount the retainer plates so as to allow the retainer plate to pivot about the fastener. As shown in FIG. 6, the retainer plate 142 may be pivoted toward and away from a position wherein a leg 148 of the retainer plate extends across the slot 130 to block the movement of the lever 122 along the slot. A protrusion 150 is formed on the leg 148 of the retainer plate and it extends toward the respective plates 132 and 134. A notch 152 is formed in each of the plates 132 and 134 and receives the protrusion 150 and serves as a catch to selectively hold the position of the retainer plates when they are positioned across the slot 130.

A pin receiving member 154 is connected to each of the hinge plates 64 at a location that is closely adjacent to the first end portion 118 of the pin assembly 114. The pin receiving member 154 includes a bifurcated base member 156 that forms a pair of uprights 158. A cap 160 spans the uprights 158 and is secured thereto by threaded fasteners 162. The cap and the uprights form a socket 164 that is sized to receive the first end 118 of the pin assembly 114 in load bearing engagement with a lower surface 166 of the cap 160. A plurality of shims 168 may be utilized to adjust the height of the cap with respect to the uprights and the first end 118 of the pin assembly 114 to achieve a proper load bearing relationship between the pin and the cap.

Industrial Applicability

When attaching a bucket or other work implement 12 to a vehicle such as an excavator, the support arm 14 is manipulated to bring the first end portions 22 of the connecting links 16 into engagement with the first receptacles 68, as shown in FIG. 3. This is accomplished with the aid of the guide plates 76 which help to axially "steer" the movement of the connecting links as they approach engagement with the receptacles. After the first end portions 22 of the connecting links are seated, the hydraulic cylinder of the rotating means 40 is actuated to rotate the second end portions 24 of the connecting links 16 into engagement with the second receptacles 70. When the connecting links are properly seated, the wedge members 90 which have been held in a position forward of the rear edge 98 of the connecting links 16 are moved rearwardly toward the flanges 84 formed on the hinge plates 64. This movement may be accomplished by striking the angled portion 101 or the lugs 102 of the wedge members 90 with a hammer or similar tool. As the wedge members 90 are moved toward the flanges 84, the angled portion 100 of the wedge members 90 engages the angled portion 86 of the flanges in face-to-face relation. Under the urging of the hammer, the angled portions 100 and 86 are forced into tighter engagement with each other and thus the connecting links are urged into tighter seating within the respective receptacles 68 and 70. When a tight engagement is achieved, the bolts 94 may be tightened to hold the wedge member 90 in position.

When detaching the bucket 12 from the excavator, the process is basically reversed. The bolts 94 are loosened, the wedge members 90 are moved forwardly with the aid of a hammer striking the lugs 102, and the excavator linkage is manipulated to remove the connecting links 16 from engagement with the receptacles 68 and 70 in the hinge plates 64. It may be seen that as this procedure is performed frequently over a period of time, that substantial wear may occur between the components. This wear is accommodated by the face-to-face engagement of the respective angled portions 86 and 100 of the flange 84 and the locking means 82.

Turning now to FIGS. 4–6, the operation of the alternate embodiment of the locking means 82' will be described. The initial operation of the excavator linkage is identical to that previously set forth, when bringing the connecting links 16 into engagement with the receptacles 68 and 70 of the hinge plates 64. Once the connecting links are properly seated, the lever 122 of the pin assembly 114 may be freed from its "stored" position. This is accomplished by moving the retainer plates 142 vertically away from the respective upper and lower plates 132 and 134 until the protrusions 150 of the retainer plates 142 clear the slots 152 in the upper plates and lower plates 132 and 134. Having done that, the retainer plates 142 may be rotated about their mounting bolts 144 to a position that does not obstruct the slots 130 as shown in phantom lines in FIG. 6. Thereafter the levers 122 of the individual pin assembly 114 may then be grasped by the operator and moved downwardly in their respective slot 130. Since the slot is angled, the first (or rearward) end 118 of the pin body 118 is moved toward the pin receiving member 154. It should be noted that during the initial movement of the lever, the first end portion 118 of the pin body 116 enters the socket 164 formed in the pin receiving member 154. The relieved portion 120 formed on the first end portion 118 is positioned on the circumference in a manner that allows a space between the pin body 116 and the lower surface 166 of the cap 160 as the pin body enters the socket. As movement of the pin body continues, the relieved portion is rotated away from its initial orientation with the lower surface 166 of the cap, and the space therebetween is reduced as the lever 122 is lowered. When the lever has traversed the entire length of the slot 130 to a position shown in phantom lines in FIG. 4, the pin body 116 has been entirely advanced and rotated to a position wherein it is in load bearing contact with the lower surface 166 of the cap member. Upon the completion of pin engagement, the retainer plates 142 may again be rotated back to their stored position. The retainer plates 142 will be positioned across the slot 13 and will cooperate with the lower plate 134 to hold the handle against upward movement in the slot 130. Release of the pin may occur by reversing the above procedure. When disengaged, the position of the lever 122 is held against downward movement in the slot 130 by the retainer plate 142 that is associated with upper plate 132. As previously discussed, the height of the cap 160 with respect to the uprights 158 may be adjusted with the use of shims 168. The height may be set originally to compensate for any manufacturing tolerances that may vary the proper distance from bucket to bucket. The height may also be adjusted later to compensate for wear. Also, the relieved portion 120 on the pin body 116 compensates for any dirt build-up that may occur during operation and greatly eases the seating of the pin.

With a coupling apparatus 10 as disclosed, a bucket may be mounted to the linkage arrangement of the vehicle at the same points of attachment as that of a conventional bucket. This is mainly due to the configuration of the connecting links 16. Since the connecting links are provided with the concave portion 20 they are able to nest very closely about the convex portion 74 of the reinforcement beam 72. By doing so, the distance between the teeth of the bucket and the first pin member 34 about which the bucket rotates, remains the same as that of a conventional bucket. This distance is commonly referred to as the tip radius, and since it remains unchanged, the optimum use of the available digging force that is provided by the hydraulic cylinder also remains unchanged. Another advantage resides in the absence of reinforcing structure extending laterally between the connecting links 16. The entire widths of the contoured first and second end portions 22 and 24 are in load bearing engagement with their respective receptacles 68 and 70. This allows the direct, in-line transmission of digging forces from the hinge plates 64 to the connecting links 16 and vice versa, thus allowing the elimination of the reinforcing structure. The only members that extend between the connecting links are the first and second pin members 34 and 52 which serve mainly as pivot mountings and not structural support. This permits the normal operation of the bucket rotating means 40 without having to compensate for any interference with from additional structure. Also, since there is very little structure added to that of a conventional bucket, the weight increase and the resulting loss of bucket capacity is minimal.

Other aspects, objects and advantages of this invention can be obtained from a study of the drawings, the disclosure and the appended claims.

We claim:

1. A coupling apparatus for use between a pair of support arms having distal ends, and a work implement, comprising:

a pair of hinge plates mounted on the work implement, each defining first and second contoured receptacles that are spaced from one another;

a pair connecting links having a generally uniform length and width and first and second end portions pivotally connected between said distal ends of said support arms and being configured for nesting engagement within the first and second receptacles respectively;

a guide plate secured to each hinge plate at a location that is adjacent one of said first and second receptacles to guide the first end portion of said connecting links into engagement with one of said receptacles and to limit the axial movement of the connecting links with respect to the hinge plates upon completion of said engagement;

locking means associated with the connecting links for selectively locking the end portions into engagement with said receptacles with substantially the entire length and width of each connecting link in direct, linear force transmitting relation therewith;

a first pin member extending between the first end portions of the respective connecting links to pivotally mount said connecting links to one of said support arms; and a second pin member extending between the second end portions of the connecting links to pivotally mount the connecting links to the other of said support arms, said first and second pin members being the only structural connection between said connecting links.

2. The coupling apparatus as set forth in claim 1 wherein a means for rotating the work implement with respect to said one support arm about the first pin member is included, said rotating means extending between said one support arm and said second pin member.

3. The coupling apparatus as set forth in claim 2 wherein said rotating means includes:

a pair of idler links having a first end portion rotatably mounted to said one support arm and a second end portion;

at least one power link having a first end portion rotatably connected to the second pin member and a second end portion rotatably engaged with the second end portions of said idler links, said power link being the other of said support arms; and an actuating member positioned between said one support arm and the connection between the second end portions of the power link and the idler links.

4. The coupling apparatus as set forth in claim 1 wherein said locking means further includes:

a flange member having an angled surface defined thereon and being mounted to each of said hinge plates;

a wedge member having an angled surface defined thereon and an elongated slot formed therethrough; and fastening means positioned within the elongated slot to secure the wedge member to each of the connecting links for selective movement of the angled surface of the wedge member into and out of engagement with the angled surface of the flange member.

5. In a vehicle having a support arm, a bucket defining a pair of hinge plates that extend from said bucket in spaced relation to each other, and a linkage arrangement associated with said support arm and said bucket to provide rotation of said bucket with respect to the support arm, an apparatus for rapidly coupling and uncoupling said bucket and the support arm, comprising:

a first receptacle formed in each of the hinge plates having a preselected contour;

a second receptacle formed in each of the hinge plates having a preselected contour and being spaced from the first receptacle;

a pair of connecting links having a first end portion having a configuration sufficient for nesting engagement with the first receptacle, and a second end portion having a configuration sufficient for nesting engagement with the second receptacle;

means for selectably locking the engagement of the first and second end portions of the connecting links with the first and second receptacles; and, means for pivotally mounting the first end portions of the connecting links to the support arm and the second end portion of the connecting links to the linkage arrangement, said means being the only structure extending between the connecting links; and a guide plate secured to each hinge plate at a location that is adjacent one of said first and second receptacles to guide the connecting links into engagement with the first and second receptacles and to limit the axial movement of the connecting links with respect to the hinge plates upon completion of said engagement.

6. The coupling apparatus as set forth in claim 5 wherein said connecting links each have a bore defined in each end portion, said connecting links being positioned on opposite sides of the support arm with the bores of the first end portions of the connecting links aligned with a bore extending through the support arm.

7. The coupling apparatus as set forth in claim 6 wherein said mounting means between said connecting links includes:

a first pin member secured to one of said connecting links and being positioned within the aligned bores defined by the first end portion of the connecting links and the support arm, to rotatably mount the connecting links thereto, and a retaining means secured to the first pin member to limit the axial and rotational movement thereof with respect to the connecting links; and a second pin member secured to one of the connecting links and being positioned within the bores defined by said second end portions of the connecting links, and a retaining means secured to the second pin member to limit axial movement thereof with respect to the connecting links.

8. The coupling apparatus as set forth in claim 5 wherein the linkage arrangement for rotating the bucket with respect to the support arm is connected between the support arm and the second end portions of the connecting links.

9. The coupling apparatus as set forth in claim 8 wherein said linkage arrangement for rotating the bucket further includes:

a pair of idler links having first and second end portions said first end portions being rotatably mounted to the support arm;

at least one power link having first and second end portions, said first end portion being rotatably mounted to the second end portion of the connecting links and the second end portion of the power link being rotatably mounted to the second end portions of the idler links; and an actuating member positioned between the support arm and the second end portions of the idler and power links.

10. The coupling apparatus as set forth in claim 5 wherein the first receptacle has a generally semi-circular configuration and the second receptacle is defined by a portion of a circle that is greater than 90° but less than 180°, said receptacles being positioned to substantially face each other.

11. The coupling apparatus as set forth in claim 5 wherein said locking means further includes:

a receiving member having a socket defined therein, said receiving member being connected to each of the hinge plates;

a cylindrical member defining a centrally disposed bore and an angled slot, and being mounted on each of said connecting links with the bore of the cylindrical member in axial alignment with the socket of the receiving member;

a pin assembly having a first end portion and a second end portion, and a lever connected to the second end portion thereof, said lever extending from the pin assembly and being positioned within the angled slot wherein selective movement of the lever along said angled slot will move the first end portion of the pin assembly into and out of engagement with the socket of the receiving member.

12. The coupling apparatus as set forth in claim 11 wherein the first end portion of the pin assembly has a relieved portion formed around a portion of its circumference so that the pin assembly will not be brought into contact with the receiving member along a load bearing portion thereof during initial movement of the pin assembly into the socket of the receiving member.

13. In an excavating vehicle such as a backhoe having a boom member, a stick member pivotally mounted to said boom member, an idler link assembly pivotally connected to the stick member, a power link assembly pivotally connected to the idler link assembly, and a bucket having a pair of spaced apart, substantially non-deformable, hinge plates formed thereon, a pair of spaced apart receptacles defined in each hinge plate, and a generally convex protrusion positioned laterally between the hinge plates, an apparatus adapted to expeditiously couple and uncouple said bucket to said stick member and said power link, comprising:

a connecting link assembly having a pair of link members, each link member having a generally uniform length and width and being of one-piece construction and having a first end connected to the power link assembly, said end connected to the stick member and a second end portions being adapted for engagement with one of the respective pairs of receptacles in direct linear force transmitting relation therewith, and having a first and second pin member extending between the respective end portions of the connecting links as the sole means of interconnection therebetween, each link member defining a concave portion intermediated its end portions that is positionable in closely adjacent relation to said convex protrusion, said link members being laterally positioned from one another to form a space therebetween, said space being sufficient to allow movement of the power link assembly therewithin to a position immediately adjacent the convex protrusion of the bucket; and means associated with the connecting links for selectively locking the end portions thereof into engagement with said receptacles.

14. The coupling apparatus as set forth in claim 13 wherein the first pin member secures the first end of each connecting link to the stick member and the second pin member secures the second end of each connecting link to the power link assembly.

15. The coupling apparatus as set forth in claim 14 wherein a hydraulic actuator is positioned between the stick member arm and the connection between the idler and power link assemblies to rotate the bucket about the first pin member to selectively position the power link assembly between the connecting links.

16. A coupling apparatus for use between a pair of support arms having distal ends, and a work implement, comprising:

a pair of hinge plates mounted on the work implement, each defining a pair of contoured receptacles that are spaced from one another;

a pair of connecting links having first and second end portions pivotally connected between said distal ends of said support arms and being configured for nesting engagement within the receptacles;

a flange member having an angled surface defined thereon and being mounted to each of said hinge plates;

a wedge member having an angled surface defined thereon and an elongated slot formed therethrough; and fastening means positioned within the elongated slot to secure the wedge member to each of the connecting links for selective movement of the angled surface of the wedge member into and out of engagement with the angles surface of the flange member.

17. A coupling apparatus for releasably mounting a bucket member to a compound linkage arrangement, comprising:

a pair of hinge plates adapted to be mounted on the bucket member in substantially rigid, non-deformable relationship therewith;

means for directly pivotally connecting said compound linkage arrangement to said hinge plates, said connecting means including a pair of connecting links, each link having a first and second end portion and being positionable to engage one of the respective hinge plates with their end portions aligned in direct, linear force transmitting engagement therewith;

a first and second pin member extending laterally between the respective first and second end portions of the connecting links to pivotally mount the connecting links to the respective bucket and compound linkage arrangement, said pin members being the sole interconnection between said connecting links; and means for simultaneously engaging each connecting link and its corresponding hinge plate and locking them together, said engaging means being positioned in linear relation to both the connecting link and the hinge plate so that forces passing through the engaging means are transmitted along a substantially linear path.

* * * * *

UNITED STATES PATENT AND TRADEMARK OFFICE

CERTIFICATE OF CORRECTION

PATENT NO. : 4,854,813

DATED : August 8, 1989

INVENTOR(S) : Robert L. Degeeter and Harvey A. Knell

It is certified that error appears in the above-identified patent and that said Letters Patent is hereby corrected as shown below:

Claim 13, line 9 of Column 11, delete "connected to the power".

Claim 13, line 10 of Column 11, delete "link assembly, said end".

Claim 13, line 11 of Column 11, after "end", insert --connected to the power link assembly, said end--.

Claim 15, line 36 of Column 11, delete "arm".

Signed and Sealed this

Eighteenth Day of September, 1990

*Attest:*

HARRY F. MANBECK, JR.

*Attesting Officer*

*Commissioner of Patents and Trademarks*